US008744108B2

(12) United States Patent
Trainer

(10) Patent No.: US 8,744,108 B2
(45) Date of Patent: Jun. 3, 2014

(54) BALANCED MOMENTUM INERTIAL DUCT

(75) Inventor: Mark Trainer, Northridge, CA (US)

(73) Assignee: Strata Audio LLC, Westlake Village, CA (US)

( * ) Notice: Subject to any disclaimer, the term of this patent is extended or adjusted under 35 U.S.C. 154(b) by 20 days.

(21) Appl. No.: 13/547,905

(22) Filed: Jul. 12, 2012

(65) Prior Publication Data

US 2013/0177190 A1 Jul. 11, 2013

Related U.S. Application Data

(60) Provisional application No. 61/506,992, filed on Jul. 12, 2011.

(51) Int. Cl.
*H04R 1/20* (2006.01)

(52) U.S. Cl.
USPC ..... 381/345; 381/349; 381/353; 381/354; 381/162; 381/165; 181/155; 181/156; 181/160; 181/196; 181/197

(58) Field of Classification Search
USPC ..... 381/345, 349, 353, 162, 169; 181/155, 181/156, 160, 196, 197
See application file for complete search history.

(56) References Cited

U.S. PATENT DOCUMENTS

| | | | | |
|---|---|---|---|---|
| 1,869,178 | A | 7/1932 | Thuras | |
| 4,017,694 | A | 4/1977 | King | |
| 4,987,601 | A | 1/1991 | Goto | |
| 5,335,287 | A | 8/1994 | Athanas | |
| 5,517,573 | A | 5/1996 | Polk et al. | |
| 5,623,132 | A | 4/1997 | Gahm | |
| 5,714,721 | A | 2/1998 | Gawronski et al. | |
| 5,757,946 | A | 5/1998 | Van Schyndel | |
| 5,802,193 | A | 9/1998 | Kieltyka | |
| 5,892,183 | A | 4/1999 | Roozen et al. | |
| 6,082,094 | A | 7/2000 | Longardner | |
| 6,694,037 | B1 | 2/2004 | Robinson et al. | |
| 7,177,440 | B2 | 2/2007 | Turnmire et al. | |
| 7,515,728 | B2 | 4/2009 | Kobayashi et al. | |
| 7,711,134 | B2 * | 5/2010 | Stead et al. | 381/345 |
| 7,729,504 | B2 | 6/2010 | Tsuda et al. | |
| 7,835,536 | B2 | 11/2010 | Inagaki et al. | |
| 2002/0176596 | A1 | 11/2002 | Fujinami et al. | |
| 2005/0152577 | A1 | 7/2005 | Nishimura et al. | |
| 2007/0189572 | A1 | 8/2007 | Juall | |
| 2008/0232633 | A1 | 9/2008 | Corynen | |
| 2008/0317276 | A1 | 12/2008 | Sorensen et al. | |
| 2009/0041282 | A1 | 2/2009 | Parker et al. | |
| 2009/0208048 | A1 | 8/2009 | Haas | |
| 2009/0214075 | A1 | 8/2009 | Inoue et al. | |

FOREIGN PATENT DOCUMENTS

| | | |
|---|---|---|
| WO | 90/11668 | 10/1990 |
| WO | 2010/097568 | 9/2010 |

OTHER PUBLICATIONS

Small, R., "Vented-Box Loudspeaker Systems Part II: Large-Signal Analysis", Journal of the Audio Engineering Society, pp. 326-332, 2006.

* cited by examiner

*Primary Examiner* — Davetta W Goins
*Assistant Examiner* — Amir Etesam
(74) *Attorney, Agent, or Firm* — Fish & Associates, PC

(57) ABSTRACT

A duct design and methods for designing ducts are described herein. The duct has a profile described by an equation that balances momentum of the fluid flowing through the duct with an adverse pressure gradient. The duct profile is configured to: (i) maintain the fluid's momentum to be greater than the adverse pressure gradient present at any location within the duct, such that no boundary layer separation occurs; and (ii) achieve a fluid exit momentum of approximately zero.

7 Claims, 9 Drawing Sheets

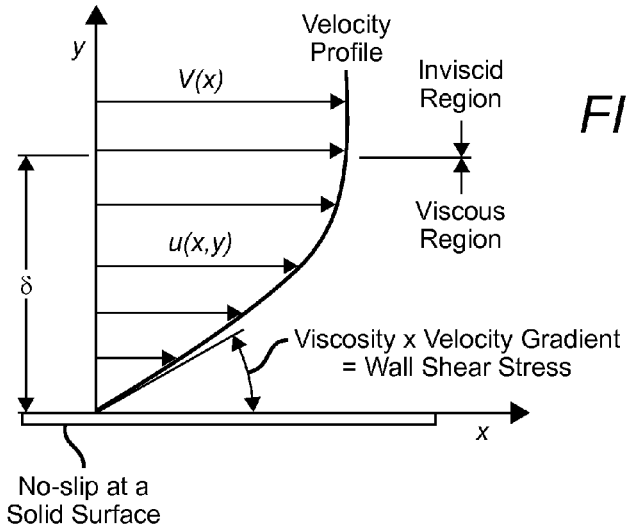
FIG. 4
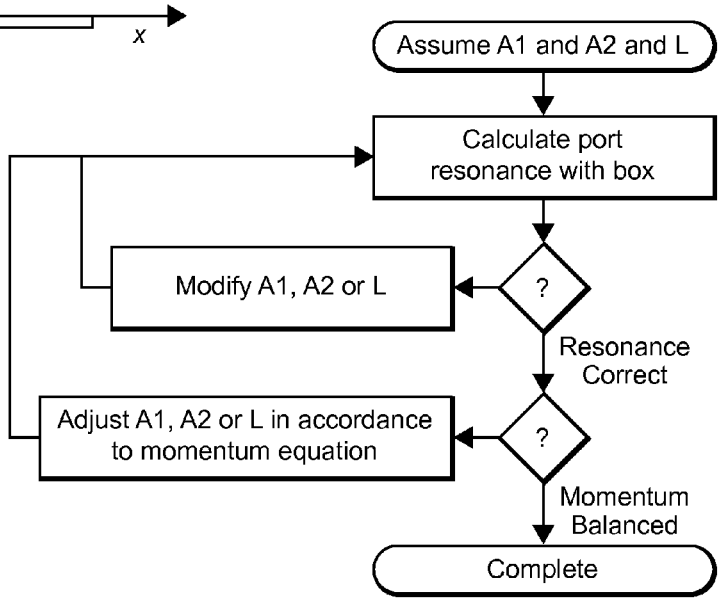
FIG. 5
FIG. 6
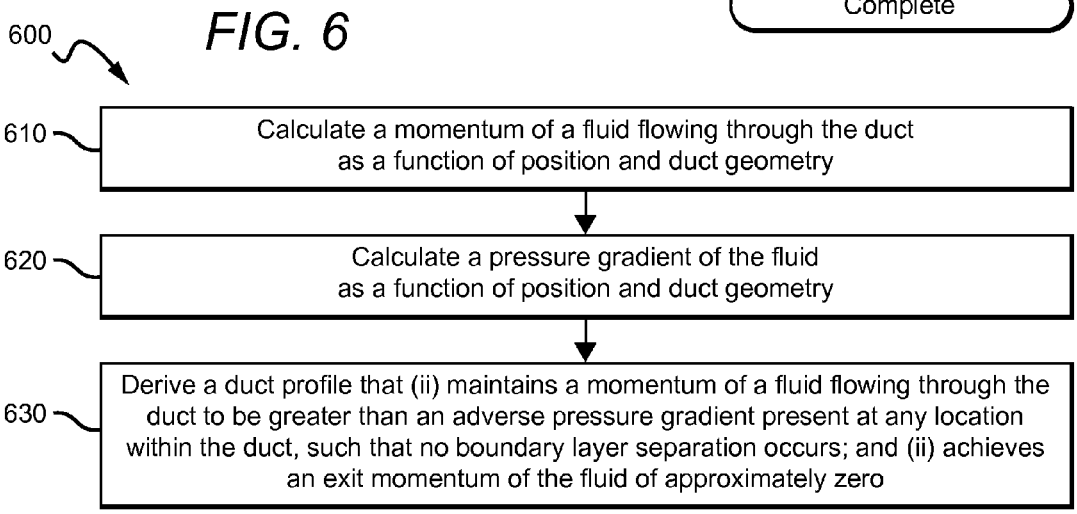

BALANCED MOMENTUM INERTIAL DUCT

This application claims the benefit of priority to provisional application Ser. No. 61/506,992 filed on Jul. 12, 2011, which is incorporated herein by reference.

FIELD OF THE INVENTION

The field of the invention is acoustic systems, more specifically, ducts for audio transducer enclosures.

BACKGROUND

The background description includes information that may be useful in understanding the present inventive subject matter. It is not an admission that any of the information provided herein is prior art or relevant to the presently claimed inventive subject matter, or that any publication specifically or implicitly referenced is prior art.

Transducers (i.e., audio loudspeakers) are well known and generally comprise a radiating surface (e.g., dome, diaphragm, membrane, cone, etc) driven by a voice coil. An electrical current is supplied to the voice coil via an amplifier, producing an electromagnetic field around the voice coil. The electromagnetic field interacts with a static magnetic field, which causes the voice coil and the radiating surface to vibrate, thus producing audio waves.

In order to improve a transducer's frequency range of audio waves, the transducer can be placed inside (or otherwise coupled with) an enclosure that has a duct (also referred to as a port). As the transducer's radiating surface vibrates, air within the enclosure is forced out of the duct, producing a sound wave at lower frequencies than the sound waves produced directly from the transducer's radiating surface. Examples of transducer enclosures with ducts can be found in U.S. Pat. No. 1,869,178. The combination of the transducer, enclosure, and duct is referred to herein as an acoustic system. Acoustic systems generally provide a larger frequency range than just the transducer alone, and enhances the listener's experience.

U.S. Pat. No. 1,869,178 and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

One common problem with ducts in acoustic systems is excessive noise at high sound pressure levels ("SPL"). Since SPL is directly related to volume (e.g., loudness), poor duct designs can severely limit the acoustic performance of an acoustic system. As used herein, "acoustic performance" refers to an acoustic system's ability to produce sound waves with desirable characteristics. Desirable acoustic characteristics may differ depending on the application. Examples of desirable acoustic characterizes may include the ability to output a large frequency range of sound at high volumes with little or no noise. As used herein, the term "noise" refers generally to audio waves other than an input signal.

One primary source of noise in acoustic system ducts is the occurrence of boundary layer separation (i.e., flow separation) and vortices along the interior length of the duct and at the exit. In order to prevent boundary layer separation and vortices, acoustic system designers have historically followed the design rule of keeping the duct's air output velocity below 5% of the velocity of sound (approximately 17 m/s). See, for example, "Vented-Box Loudspeaker Systems Part II: Large-Signal Analysis," by Richard Small (JAES Vol 21, No 6, July/August 1973). Unfortunately, this design rule leads to ducts that have larger cross-sectional areas and longer lengths for a designed resonance. For miniature acoustic systems (e.g., smart phones, tablets, flat screen displays, etc) this design rule results in unsatisfactory acoustic performance.

As an alternative approach, many designers are now providing ducts with flares (i.e., ducts that have a cross sectional areas that transition from large to small, then back to large). See, for example, U.S. Pat. Nos. 5,714,721, 5,892,183, 7,711,134, and International Patent Application Publication No. WO 90/11668. Flares help to reduce vortices at the duct exit and allow for smaller and shorter ducts than the "5% rule" for a designed resonance.

U.S. Pat. No. 5,714,721 describes another approach, in which a duct has a cross sectional profile that smoothly transitions from large-to-small-to-large. The duct's cross sectional profile is designed to expand and compress the air flow in the duct, thus reducing the air exit velocity below the recommended 5% value. U.S. Pat. No. 5,892,183 further describes a duct that has an expanding cross sectional profile of roughly seven degrees and a parabolic profile to avoid boundary layer separation. Unfortunately, these design approaches fail to fully optimize acoustic performance for any given space constraint.

U.S. Pat. No. 7,711,134 describes yet another approach, in which a duct cross sectional profile is designed as a function of its pressure gradient. More specifically, the duct is configured such that it achieves a constant pressure gradient. A similar approach is described in International Patent Application Publication No. WO 90/11668, which describes a duct that has an elliptical/hyperbola profile. While advantageous in some aspects, this approach unnecessarily limits the duct design to only those shapes and configurations that result in constant pressure gradients. More importantly, this approach fails to account for the real underlying factors that affect boundary layer separation and, like the previous approaches, fails to fully optimize acoustic performance for any given space constraint.

While these design approaches provide some improvement to previous acoustic systems, they fail to appreciate the true underlying factors that affect the performance of acoustic systems. It would be advantageous to provide an approach to duct designing that better optimizes acoustic performance within a constrained space by accounting for the underlying factors that affect the acoustic performance.

Thus there is still a need for improved duct designs and duct design rules.

SUMMARY OF THE INVENTION

The inventive subject matter provides apparatus, systems, and methods in which a duct of an enclosure for an audio transducer has a profile described by the following equation:

$$A(x) = \frac{A_1}{\left[\left(\frac{g(x)}{g(L)}\right)^a\left(\left(\frac{A_1}{A_2}\right)^{\frac{1}{c}} - 1\right) + 1\right]^c}$$

where $1.0<a<1.5$ and $0.5<c<1.5$.

The inventive subject matter also provides a apparatus, systems, and methods in which a duct of an enclosure for an audio transducer has a profile that: (i) maintains a momentum of a fluid flowing through the duct to be greater than an adverse pressure gradient present at any location within the duct, such that no boundary layer separation occurs; and (ii) achieves an exit momentum of the fluid of approximately zero.

In one aspect, the inventive subject matter provides a duct that optimizes available space to provide the best possible sound quality and acoustic performance.

Various objects, features, aspects, and advantages of the inventive subject matter will become more apparent from the following detailed description of preferred embodiments, along with the accompanying drawing figures in which like numerals represent like components.

BRIEF DESCRIPTION OF THE DRAWINGS

FIG. 4 shows a graph that illustrates boundary separation.

FIG. 5 shows a schematic of a method of designing a duct profile.

FIG. 6 shows a schematic of another method of designing a duct profile.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

One should appreciate that the disclosed devices and techniques provide many advantageous technical effects, including improved duct designs for acoustic systems.

Figure 1:
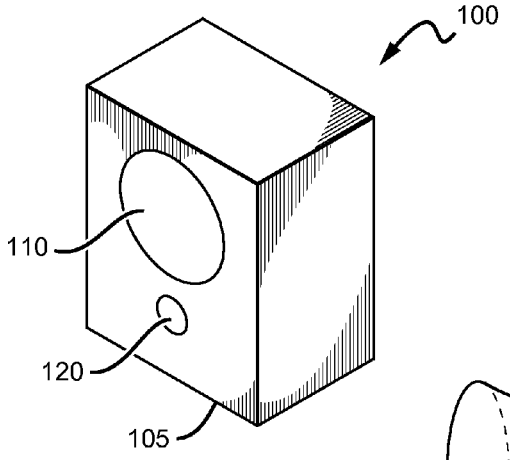
FIG. 1 shows a perspective view of an acoustic system.

FIG. 1 shows an acoustic system 100, which comprises an enclosure 105, an audio transducer 110 coupled with the enclosure 105, and duct 120. Acoustic system 100 produces sound waves at transducer 110 and duct 120 when a signal is supplied to transducer 110. More specifically, audio transducer 110 has a radiating surface (e.g., dome, diaphragm, membrane, cone, etc) that vibrates when a signal is supplied to transducer 110. As the radiating surface vibrates, air is displaced to create audio waves.

Transducer 110 can be any transducer suitable for producing audio waves via air displacement. Audio transducers are well known and the technology is constantly evolving. The present inventive subject matter is not intended to be limited by any particular transducer configuration.

Enclosure 105 can be made of any material and have any shape suitable for meeting the specifications of a user. Enclosures for acoustic systems are also well known and the present subject matter is not intended to be limited to any particular enclosure configuration. In some embodiments, enclosure 105 may comprise a wooden box. In other embodiments, enclosure 105 could comprise a housing of another device, such as a smart phone, laptop, flat screen or television, and could even comprise the housing of the other device. In yet other embodiments, enclosure 105 could comprise a compartment within the housing of another device.

Figure 2:
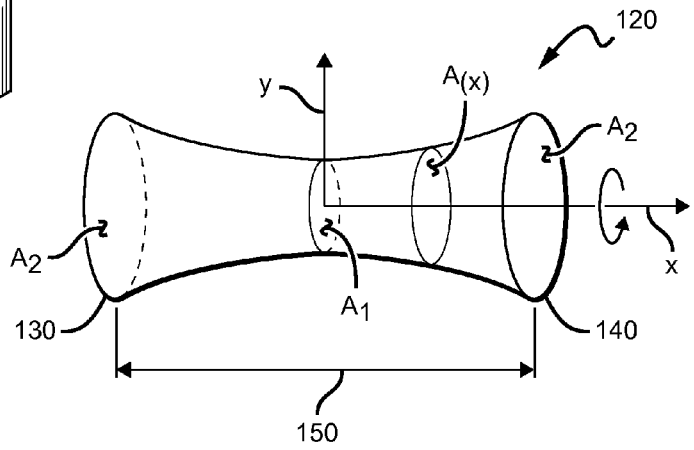
FIG. 2 shows a duct profile.

FIG. 2 shows a profile view of duct 120. Duct 120 has a first end 130, a second end 140, and a length 150. Axes x and y are show for demonstrative purposes. Length 150 of duct 120 extends along, and parallel to, the x-axis. At each point along the x-axis duct 120 has a cross sectional area shown as area A(x). Ends 130 and 140 each have a cross sectional area $A_2$.

Conceptually, duct 120 can be formed by rotating a radius about the x-axis creating an axis-symmetric geometry. However, those of ordinary skill in the art will appreciate that the inventive subject matter can be applied to non-symmetric geometries, including ducts that have are non-linear (e.g., curved lengths) and irregular cross sectional areas. Duct 120 has an axis-symmetrical shape merely for simplicity in illustrating the inventive subject matter.

First end 130 of duct 120 is placed at an exterior surface of enclosure 105 and provides an exit (or outlet). Second end 140 is placed in an interior space of enclosure 105 and provides an inlet. When transducer 110 is in use (i.e., its radiating surface is vibrating) air is driven into duct 120 via end 140 and out of enclosure 100 via end 130. The inertia mass of the air flowing out of end 130 resonates with enclosure 105 creating a sound wave that has lower frequencies than the sound waves produced by the radiating surface of transducer 110 alone (i.e., without enclosure 100 or duct 120).

The air flowing through duct 120 has various properties that are of particular importance to acoustic performance and sound quality. Some of these properties include velocity, momentum, pressure, pressure gradient, and flow type (e.g., laminar, turbulent). Higher air flow velocities, for example, produce a higher SPL at any given frequency than lower air flow velocities. Higher velocities also produce more turbulent flow at the duct exit, resulting in greater noise. The properties of the air flow are directly related to the geometrical characteristics of duct 120. As such, the length, cross sectional shape, angle of flaring, and other characteristics of duct 120 are important in determining acoustic performance. Flaring at the ends of duct 120, for example, can reduce turbulent flow by slowing down the air flow before separation occurs.

The inventive duct designs and design rules contemplated herein provide a flexible design approach that results in better acoustic performance for a given space constraint, or smaller duct footprints for a given acoustic performance requirement. Rather than reducing air flow velocity or maintaining a constant pressure gradient, the presently contemplated approach generally comprises: (i) maintaining a momentum of the air flowing through the duct to be greater than an adverse pressure gradient present at any location within the duct, such that no boundary layer separation occurs; and (ii) providing an exit momentum of the air of approximately zero. The merits of this design approach is best understood in terms of a fluid dynamics analysis.

Fluid Dynamic Fundamentals

The most basic fluid dynamics analysis involves two governing equations. First, the continuity equation, which dictates the conservation of mass as follows:

$$\dot{m}=const \tag{1}$$

Figure 7:
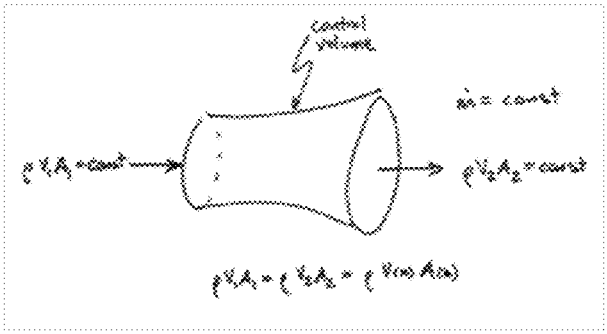
FIG. 7 shows a schematic of the conservation of mass principle.

FIG. 7 illustrates the conservation of mass principle, where V is velocity, A is area, and ρ is density.

Second, Bernoulli's equation, which dictates the conservation of energy (note that potential energy has been omitted—the analysis assumes the duct is either horizontal or short enough such that any potential energy due to elevating is significantly tiny):

$$p + \frac{1}{2}\rho v^2 = const \tag{2}$$

For these equations to be valid the following assumptions must hold:

1. The duct inlet and outlet have the same flow rate. The control volume of the duct has a constant mass.
2. The flow is incompressible
   a. For adiabatic process (valid for linear acoustics) the maximum velocity is less than 30% the speed of sound (V<100 m/s)
3. The flow is inviscid (no viscosity)
   a. There is no boundary layer separation, the air is moving in unison along the profile with a constant velocity profile normal to the cross-sectional area The first and second assumptions are relatively accurate for the acoustic systems contemplated herein. The third assumption, on the other hand, is grossly inaccurate due to the boundary layers present in the duct flow. The results of these analyses still give insightful results but are not conclusive.

Derivation

From the conservation of mass and the flow rate, the following relationship is made between velocities and the cross sectional area of the ducts:

$$v(x) = \frac{V_1 A_1}{A(x)} \tag{3}$$

Where the velocity inside a duct at position x is proportional to the cross-sectional area of the duct at the position x to the input velocity and input area.

Bernoulli's equation yields the pressure of the flow in a duct at any position x to be:

$$p(x) = p_1 + \frac{1}{2}\rho V_1^2\left[1 - \left(\frac{A_1}{A(x)}\right)^2\right] \tag{4}$$

where $P_1$, $V_1$, and $A_1$ are the input pressure, velocity, and area. The differential form of equation (4) yields the pressure gradient:

$$\nabla p = \frac{d}{dx}p(x) = -\frac{\rho V_1^2 A_1^2}{2}\frac{d}{dx}\left(\frac{1}{A(x)^2}\right) \tag{5}$$

Substituting equation (3) into equation (5) yields the relationship of the pressure gradient to the flow velocity:

$$\nabla p = -\rho V \frac{\partial V}{\partial x} \tag{6}$$

This pressure gradient is also known as the adverse pressure gradient, which is the pressure (i.e., force per area) that is slowing down the flow in the duct. The pressure gradient can be designed to oppose the fluid momentum slowing the fluid velocity in order to reduce the audible defects of the acoustic duct. Balancing of these opposing forces is required in order to maintain fluid contact with the duct walls and prevent boundary layer separation. Boundary layer separation is a highly undesirable affect that cannot be described with the inviscid equations—again these solutions give an interesting insight.

Integrating the pressure gradient equation (5) yields a relationship between the area at any point x and the pressure gradient at that point becomes:

$$\frac{1}{A(x)^2} = -\frac{2\nabla p}{\rho V_1^2 A_1^2}x + c \tag{7}$$

The constant of integration can be defined by setting the boundary condition when x=0:

$$c = \frac{1}{A_1} \tag{8}$$

So, for any inviscid incompressible flow the following relations always exist:

$$A(x) = \frac{A_1}{\left[1 - \frac{2\nabla p}{\rho V_1^2}x\right]^{\frac{1}{2}}} \tag{9}$$

A flow has a velocity profile governed by the conservation of mass in a controlled volume. This change in velocity has a resulting pressure governed by Bernoulli's equation. Differentiating the pressure gives the adverse pressure gradient for that duct flow. Each duct (radius/area) profile has a unique signature of velocity, pressure, and pressure gradient profiles described by equations (3), (4), and (5).

EXAMPLE 1

Elliptical Duct

As an example, consider the following duct profile, which utilizes an elliptical radius profile:

$$r(x) = R_1 + \frac{(R_2 - R_1)}{1 - \sqrt{1 - c^2}}\left[1 - \sqrt{1 - \left(\frac{x \cdot c}{L}\right)^2}\right] \tag{10}$$

where c is a constant ($0<c\leq 1$). When c=0, the duct uses the elliptical curve about x=0. When c=1, the duct uses the complete ellipse shape along the major axis. Note that $A(x)=\pi \cdot r(x)^2$.

Figure 8:
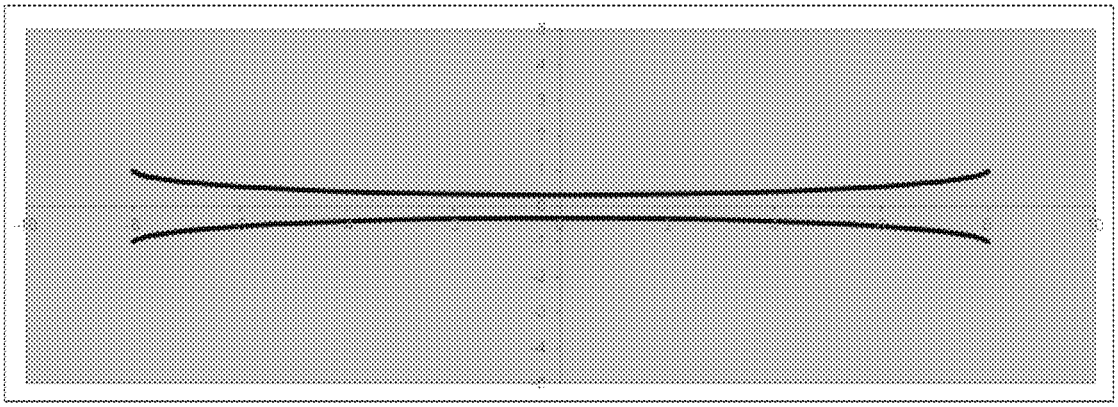
FIG. 8 shows a profile of an elliptical duct.

The profile when c=1 is illustrated in FIG. 8.

Figure 9:
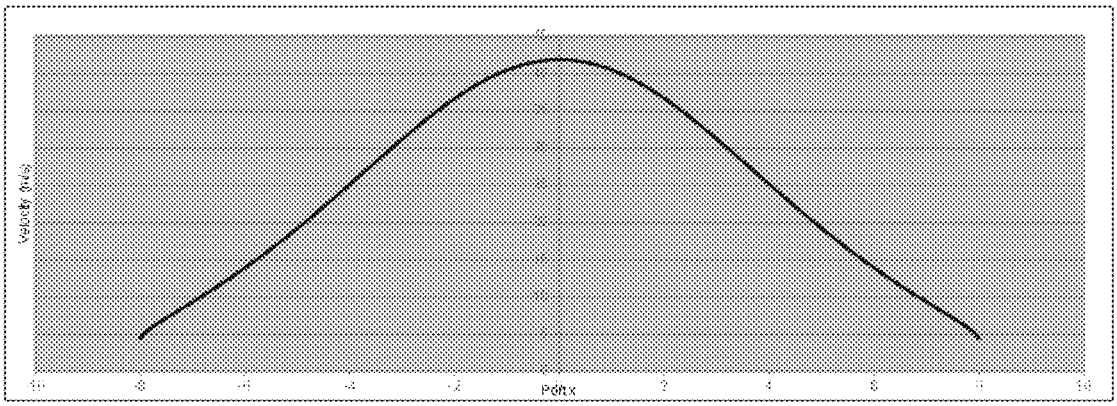
FIG. 9 shows a velocity profile of an elliptical duct.

The velocity profile when c=1 is illustrated in FIG. 9.

Figure 10:
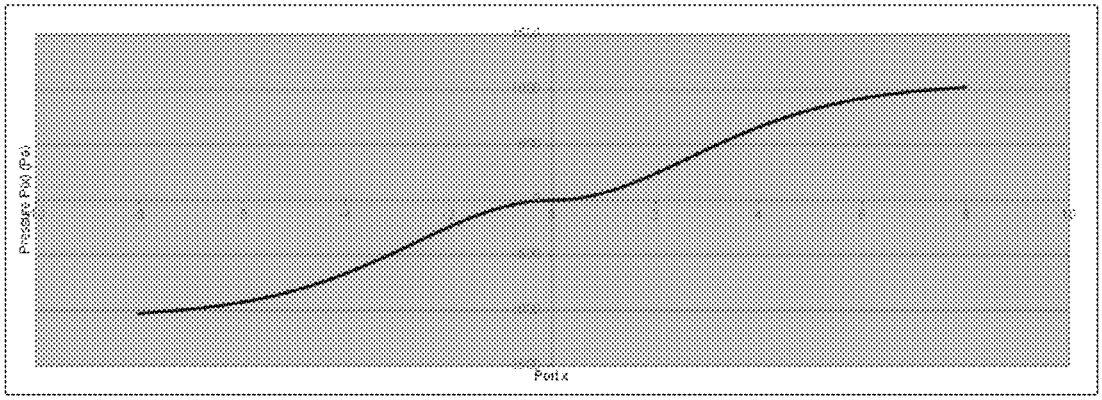
FIG. 10 shows a pressure profile of an elliptical duct.

The pressure profile (with respect to the ambient pressure) when c=1 is illustrated in FIG. 10.

Figure 11:
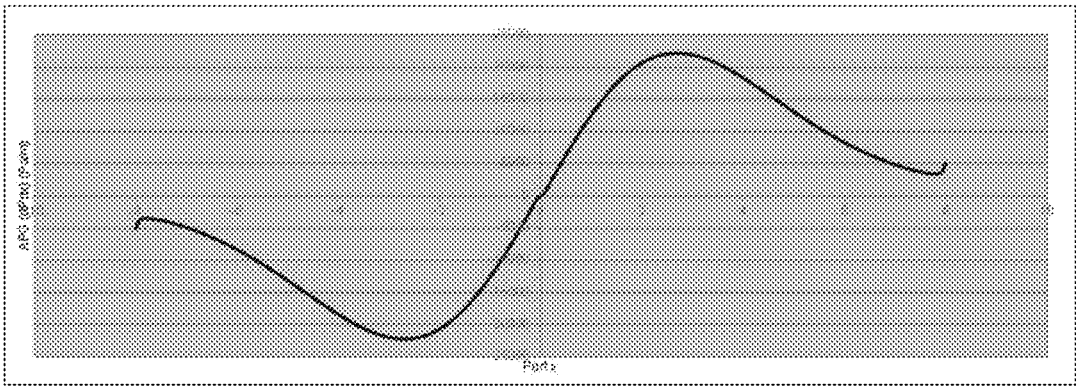
FIG. 11 shows a pressure gradient profile of an elliptical duct.

The pressure gradient profile $$\left(\nabla p = \frac{d}{dx} p(x)\right)$$

when c=1 is illustrated in FIG. 11.

EXAMPLE 2

Constant Pressure Gradient

Take another example where the adverse pressure gradient is held constant (∇p=const). In that case, when $0<x<L$ and L defines the length of the duct (i.e., substituting x=L in equation (9)), the follow equation results:

$$\nabla p = \frac{\rho V_1^2}{2L}\left[1 - \left(\frac{A_1}{A_2}\right)^2\right] \tag{11}$$

Then the area of the duct as a function of duct location becomes:

$$A(x) = \frac{A_1}{\left[1 - \frac{x}{L}\left(1 - \left(\frac{A_1}{A_2}\right)^2\right)\right]^{\frac{1}{2}}} \tag{12}$$

Or, if the area is expressed as a circular cross section, the radius is:

$$r(x) = \frac{R_1}{\left[1 - \frac{x}{L}\left(1 - \left(\frac{R_1}{R_2}\right)^4\right)\right]^{\frac{1}{4}}} \tag{13}$$

Figure 12:
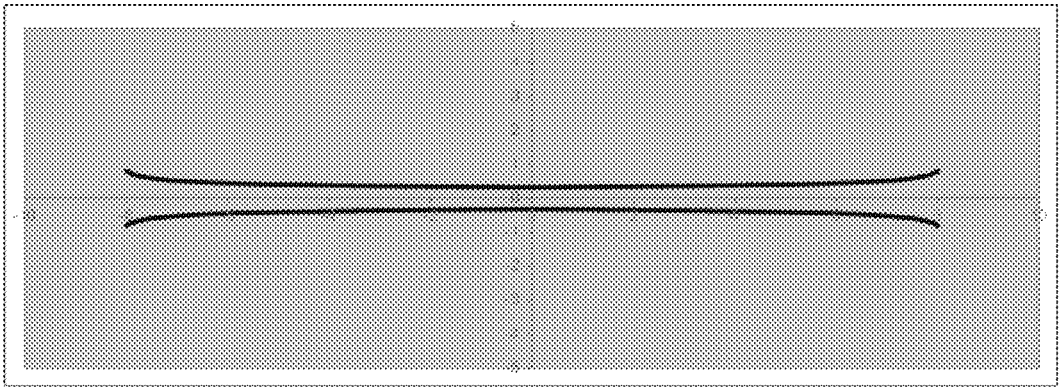
FIG. 12 shows a profile of a constant pressure gradient duct.

An example of a duct profile that achieves a constant pressure gradient (axis-symmetric about y=0) is illustrated in FIG. 12.

Figure 13:
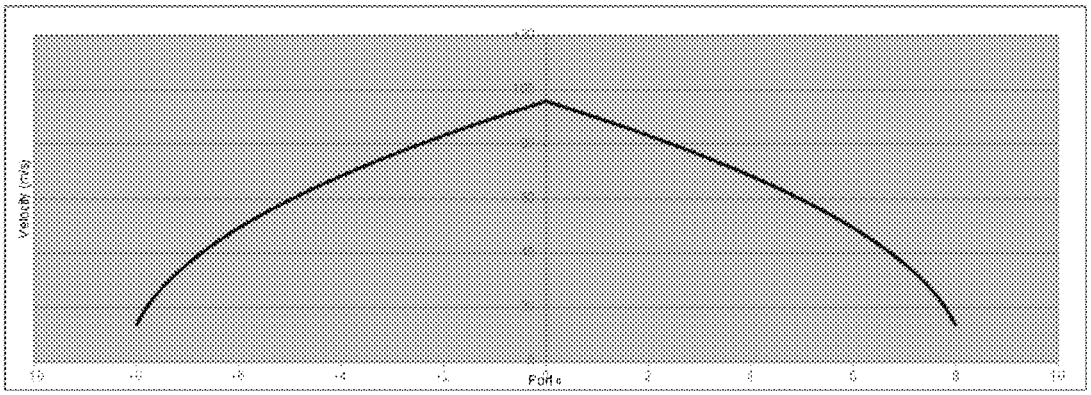
FIG. 13 shows a velocity profile of a constant pressure gradient duct.

The velocity profile of the constant pressure gradient duct is illustrated in FIG. 13.

Figure 14:
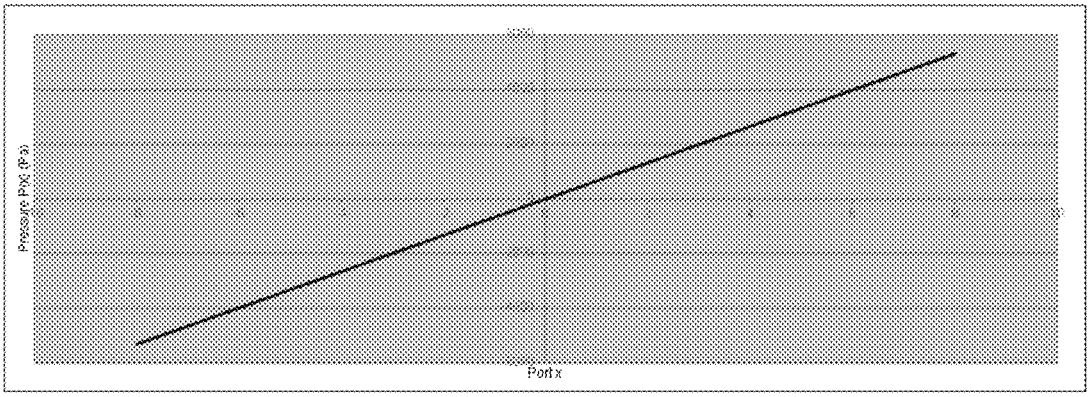
FIG. 14 shows a pressure profile of a constant pressure gradient duct.

The pressure profile of the constant pressure gradient duct is illustrated in FIG. 14.

Figure 15:
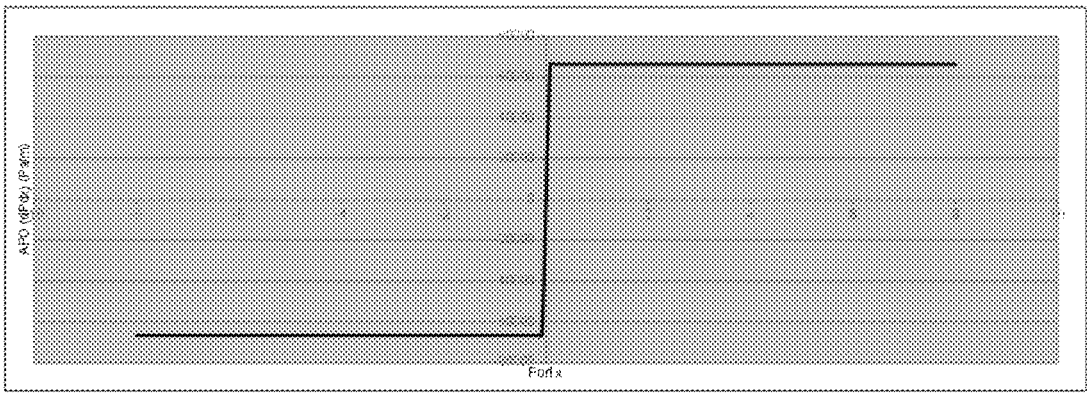
FIG. 15 shows a pressure gradient profile of a constant pressure gradient duct.

The pressure gradient profile of the constant pressure gradient duct is illustrated in FIG. 15. Note how the pressure gradient is "substantially" constant.

Generic Solution for Equation (12)

In the derivation of the equations, if the pressure gradient ∇p is not held constant, a more generic equation can be derived. Set ∇p=f(x) where f(x) is integrable such that ∫f(x) dx=g(x)+c. Then equations (12) and (13) become:

$$A(x) = \frac{A_1}{\left[\left(\frac{g(x)}{g(L)}\right)^a\left(\left(\frac{A_1}{A_2}\right)^2 - 1\right) + 1\right]^{\frac{1}{2}}} \tag{14}$$

$$r(x) = \frac{R_1}{\left[\left(\frac{g(x)}{g(L)}\right)^a\left(\left(\frac{R_1}{R_2}\right)^4 - 1\right) + 1\right]^{\frac{1}{4}}} \tag{15}$$

In a more generic form of the equation (14) can be written as:

$$A(x) = \frac{A_1}{\left[\left(\frac{g(x)}{g(L)}\right)^a\left(\left(\frac{A_1}{A_2}\right)^b - 1\right) + 1\right]^c} \tag{16}$$

If b·c=1 then the end correction holds true $A(x=L)=A_2$ and equation (16) can be simplified to:

$$A(x) = \frac{A_1}{\left[\left(\frac{g(x)}{g(L)}\right)^a\left(\left(\frac{A_1}{A_2}\right)^{\frac{1}{c}} - 1\right) + 1\right]^c} \tag{17}$$

When $$c = \frac{1}{2}$$

then the equation is derived from the duct's adverse pressure gradient profile using Bernoulli's equation. This is a necessary condition for the constant pressure gradient example. If g(x)=x, a=1, and $$c = \frac{1}{2}$$

then this equation is exactly what is disclosed in U.S. Pat. No. 7,711,134. However, when $$g(x) \neq x,\ a \neq 1 \text{ or } c \neq \frac{1}{2}$$

then the profile is not part of U.S. Pat. No. 7,711,134.

Parabolic Velocity Profile

There are many duct profiles that will satisfy equation 17. For example if one designs a velocity profile from equation (3) to be a parabola, then the area equation becomes:

$$A(x) = \frac{A_1}{\left[\left(\frac{x}{L}\right)^2\left(\frac{A_1}{A_2} - 1\right) + 1\right]} \tag{18}$$

Where in the general form is when g(x)=x, a=2, and c=1

Figure 16:
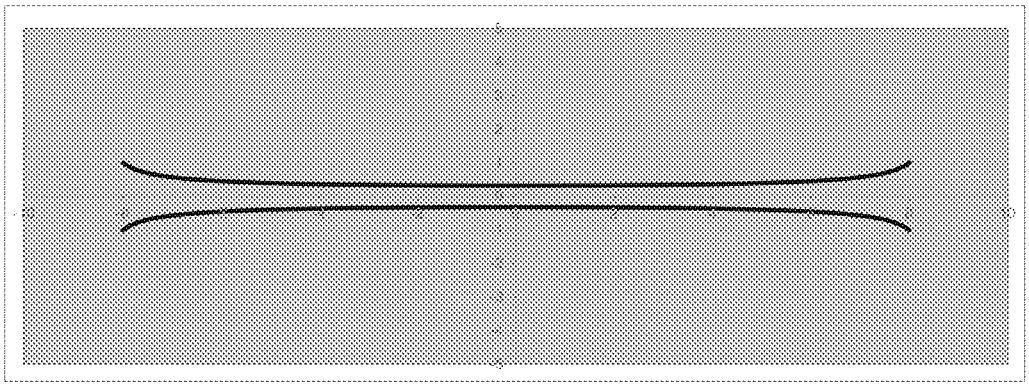
FIG. 16 shows a profile of a parabolic velocity duct.

The duct profile of the parabolic velocity duct is illustrated in FIG. 16.

Figure 17:
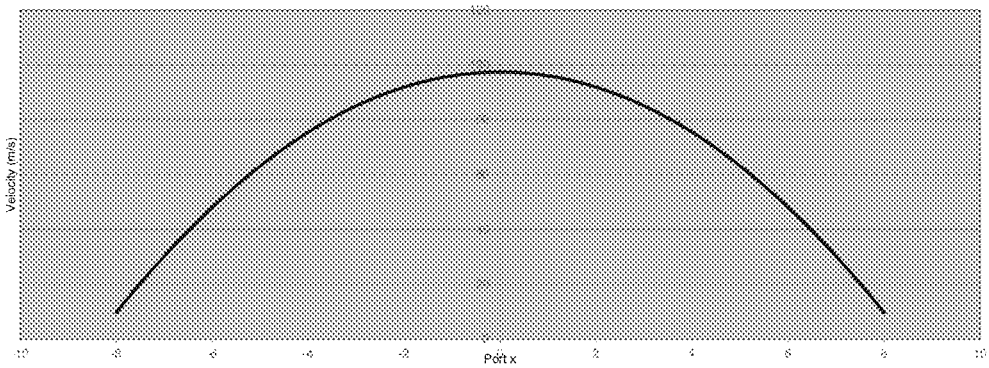
FIG. 17 shows a velocity profile of a parabolic velocity duct.

The velocity profile of the parabolic velocity duct is illustrated in FIG. 17.

Figure 18:
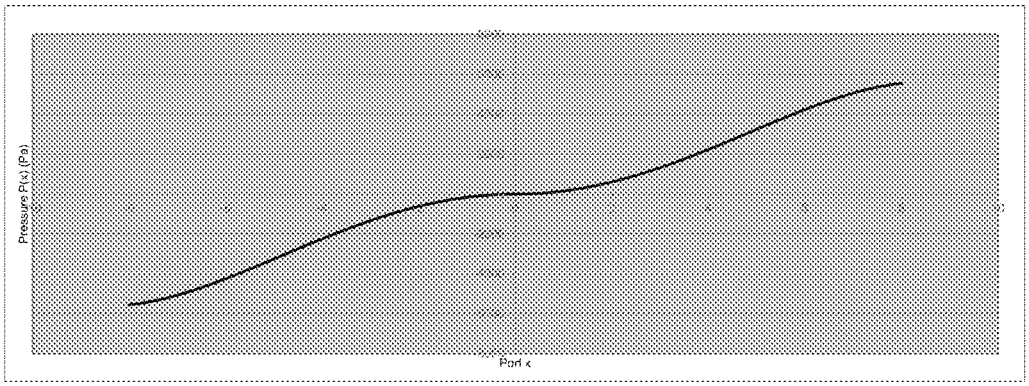
FIG. 18 shows a pressure profile of a parabolic velocity duct.

The pressure profile of the parabolic velocity duct is illustrated in FIG. 18.

Figure 19:
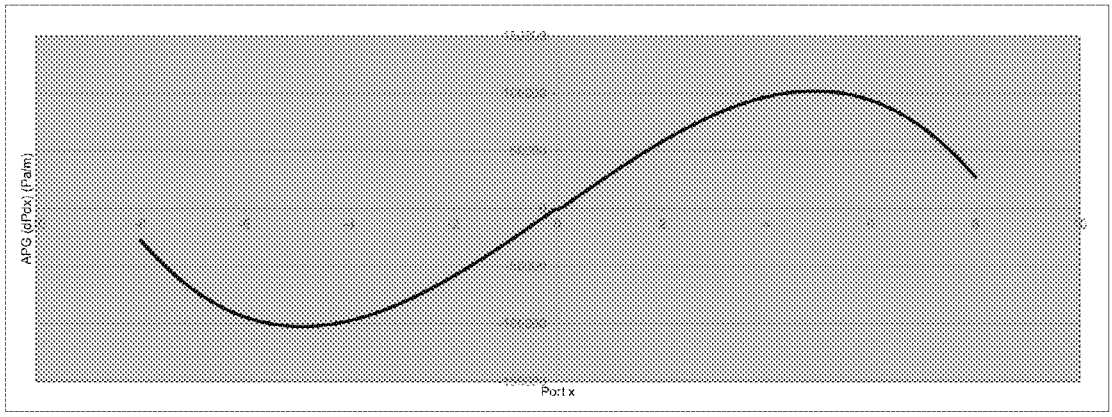
FIG. 19 shows a pressure gradient profile of a parabolic velocity duct.

The pressure gradient profile of the parabolic velocity profile is illustrated in FIG. 19.

Constant Slope Velocity Profile

Another example of a duct profile that satisfies equation 17, is the duct profile that results from a constant slope (i.e., linear velocity) velocity profile as derived from equation (3):

$$A(x) = \frac{A_1}{\left[\left(\frac{x}{L}\right)\left(\frac{A_1}{A_2} - 1\right) + 1\right]} \tag{19}$$

Where in the general form is when g(L)=L, g(x)=x, a=1, and c=1

Figure 20:
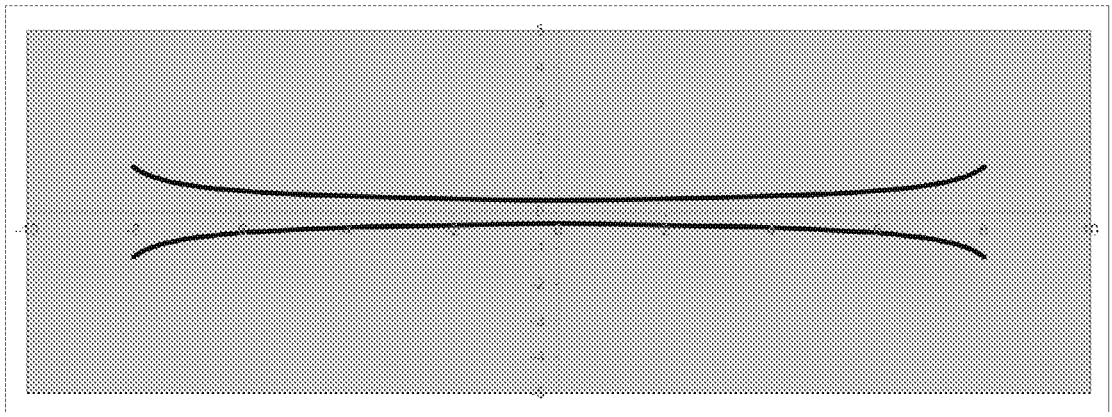
FIG. 20 shows a duct profile of a constant slop velocity duct.

A duct profile for the constant slope velocity profile duct is illustrated in FIG. 20.

Figure 21:
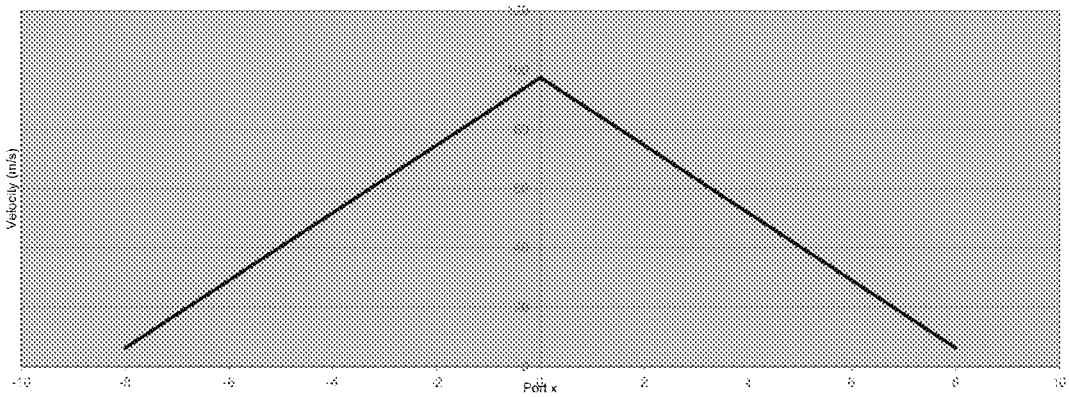
FIG. 21 shows a velocity profile of a constant slop velocity duct.

The velocity profile for the constant slope velocity profile duct is illustrated in FIG. 21.

Figure 22:
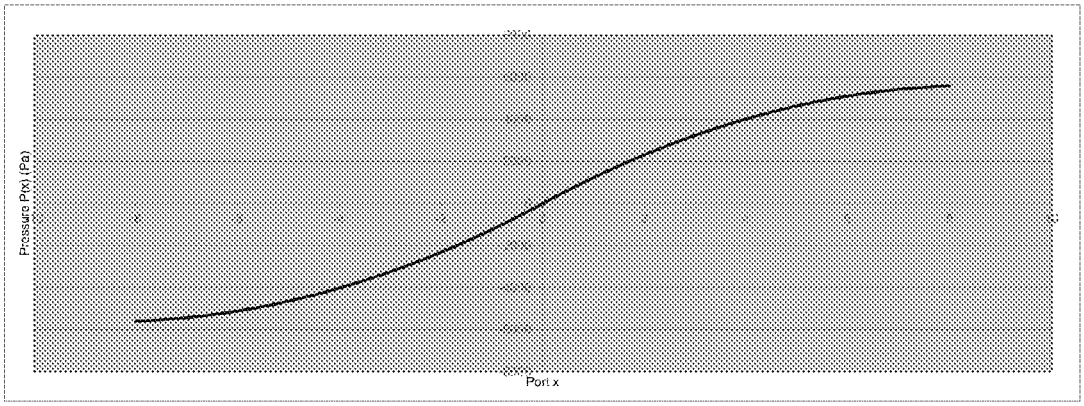
FIG. 22 shows a pressure profile of a constant slop velocity duct.

The pressure profile for the constant slope velocity profile duct is illustrated in FIG. 22.

Figure 23:
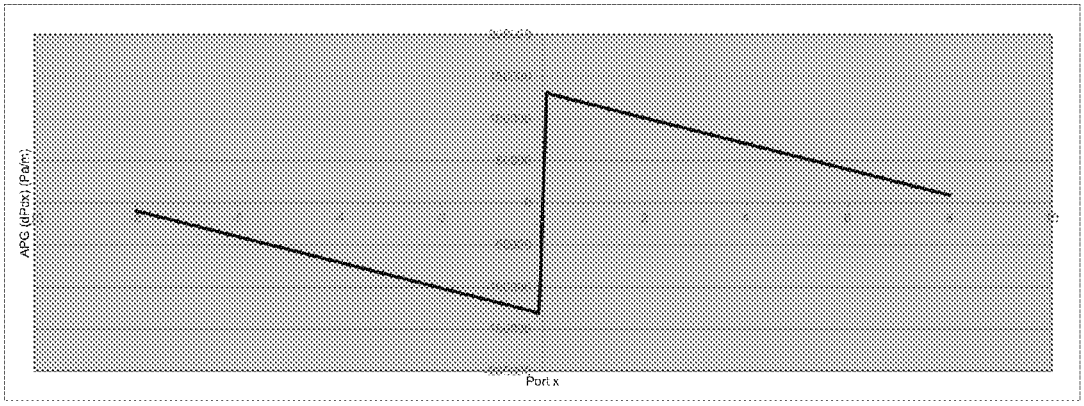
FIG. 23 shows a pressure gradient profile of a constant slop velocity duct.

The pressure gradient profile for the constant slope velocity profile duct is illustrated in FIG. 23.

One recurring deficiency in prior design approaches is the lack of consideration of viscous effects on acoustic performance. Boundary layer separation (which can create vortices and unwanted noise), must have a boundary layer. It is known that for a boundary layer to separate, an adverse pressure gradient must be present (e.g., a duct profile with an expanding cross sectional area). The existence of an adverse pressure gradient is not a sufficient condition for boundary layer separation to occur, but when the momentum of the fluid is less than the pressure gradient then separation is highly probable. The boundary layer momentum equation (expressed as a shear force on the boundary wall) is:

$$\frac{\tau_w}{\rho} = \frac{\partial}{\partial x}(V^2\theta) + \delta^* V \frac{\partial V}{\partial x} \tag{20}$$

Where:

$\tau_w$ is the shear force at the wall

V is the maximum velocity of the flow profile at any position x $\delta^*$ is the effective boundary layer thickness defined by:

$$\delta^* = \int_0^\delta \left(1 - \frac{u}{V}\right) dy \tag{21}$$

$\theta$ is the effective momentum thickness defined by:

$$\theta = \int_0^\delta \frac{u}{V}\left(1 - \frac{u}{V}\right) dy \tag{22}$$

u is the velocity profile as a function of y (or r in an axis-symmetric case) at any position x.

FIG. 4 shows an illustration of boundary layer separation.

Expanding the momentum equation using the differentiation chain rule:

$$\frac{\tau_w}{\rho} = V^2\frac{\partial\theta}{\partial x} + (\delta^* + 2\theta)V\frac{\partial V}{\partial x} \tag{23}$$

Recalling from equation (6) one can substitute the pressure gradient into the momentum equation. When the momentum equation is equal to zero, this would be the onset of boundary layer separation such that:

$$0 = V^2 - \beta\nabla p \tag{24}$$

where $$\beta = \frac{(\delta^* + 2\theta)}{\rho\frac{\partial\theta}{\partial x}} \tag{25}$$

The term $\beta$ is a property of the boundary layer of the flow at any position x. All other terms: V, $\nabla p$ are also a function of position x. $\beta$ can be rather complex and is currently solved numerically for the proposed duct profiles. A simplification (although not as accurate) is to treat $\beta$ as a constant and approximate it at the duct's exit only.

One inventive aspect of the approach to duct design described herein is to balance the momentum equation such that with a pre-calculated $\beta$ the velocity and the pressure gradient are balanced (e.g., zeroed out). This means that the flow has been reduced to its minimum possible velocity at the duct exit without boundary layer separation in the duct flow.

What is not discussed in the prior approaches to duct design is the need to balance the momentum equation by reducing the influence of the adverse pressure gradient as the flow velocity reduces during the expanding duct profile. Stated differently, when the velocity is fastest the pressure gradient should be greater and when the velocity is slower, the adverse pressure gradient should be less.

An example geometry that has this general behavior is the linear velocity profile—repeated again:

$$A(x) = \frac{A_1}{\left[\left(\frac{x}{L}\right)\left(\frac{A_1}{A_2} - 1\right) + 1\right]} \tag{19}$$

Expressing this profile in terms of an axis-symmetric radius, the duct profile would be $$r(x) = \frac{r_1}{\left[\left(\frac{x}{L}\right)\left(\frac{r_1^2}{r_2^2} - 1\right) + 1\right]^{\frac{1}{2}}} \tag{26}$$

Figure 24:
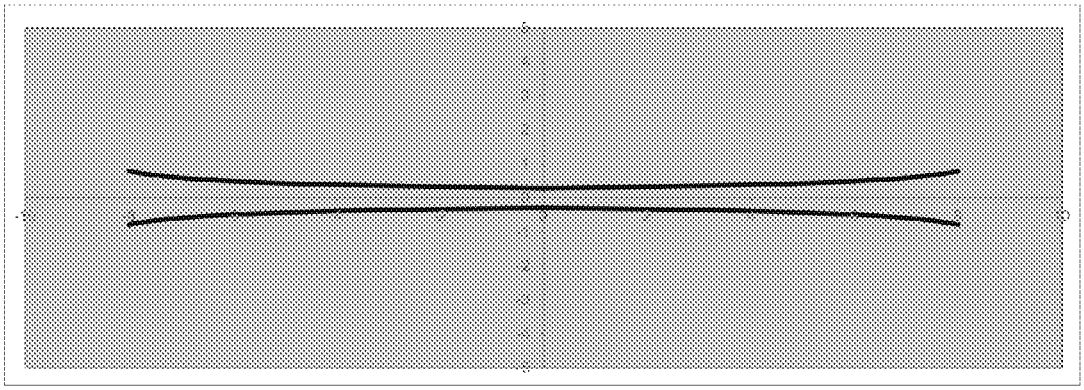
FIG. 24 shows a profile of a balanced momentum equation duct.

Illustrated in FIG. 24 is an example of a duct profile that achieves a balanced momentum equation such that the exit velocity is zero.

Figure 25:
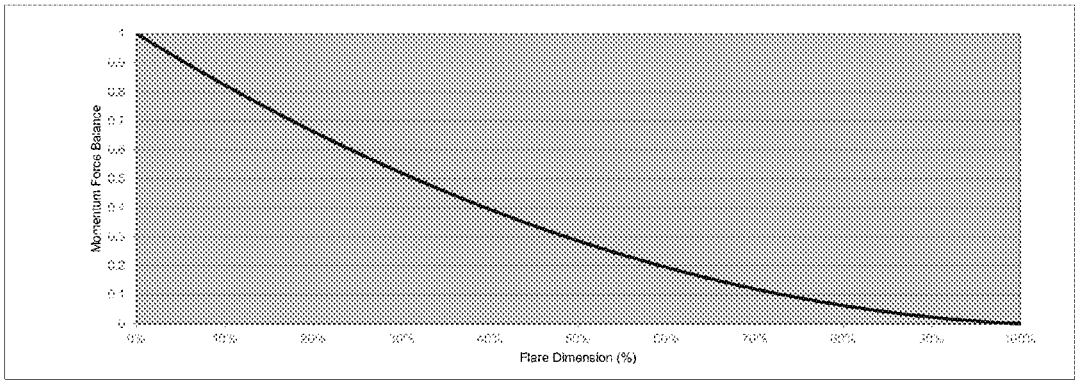
FIG. 25 shows a plot of flare dimension and momentum force balance for a duct.

The plot in FIG. 25 is normalized by the peak momentum value such that the momentum equation range maximum is 1. The x axis of the graph is a ratio of x to the length of the duct profile (x/L) always in the range from 0 to 1. Note that this expression is for only half the entire duct.

What is achieved with the present approach to duct designing is the slowing down of air in a duct. The momentum equation is balanced, eliminating the possibility of boundary layer separation and optimized such that the momentum is zero at the exit. This is the minimum velocity possible before any boundary layer separation can occur, reducing the probability of vortices forming inside the duct.

In sum, the inventive subject matter relates to:

1) The duct profile derived from a substantially linear velocity as expressed in equation (19) and (26).
2) The balance of the momentum equation (20) keeping the value favorable (≥0) such that no boundary layer separations occur in the duct.
3) Optimize the momentum equation (20) such that the equation is balanced at the duct's exit, setting the value equal to zero or approximately to zero (=0 or ≅0) guaranteeing the slowest possible average velocity of the profile without any boundary separation.

Note: Items (2) and (3) not need be restricted to the profile discussed in item (1). This method can be used for virtually all profiles where the momentum equation can be balanced. It is identified that the profile described in item (1) is desired and has benefits discussed above.

Figure 3:
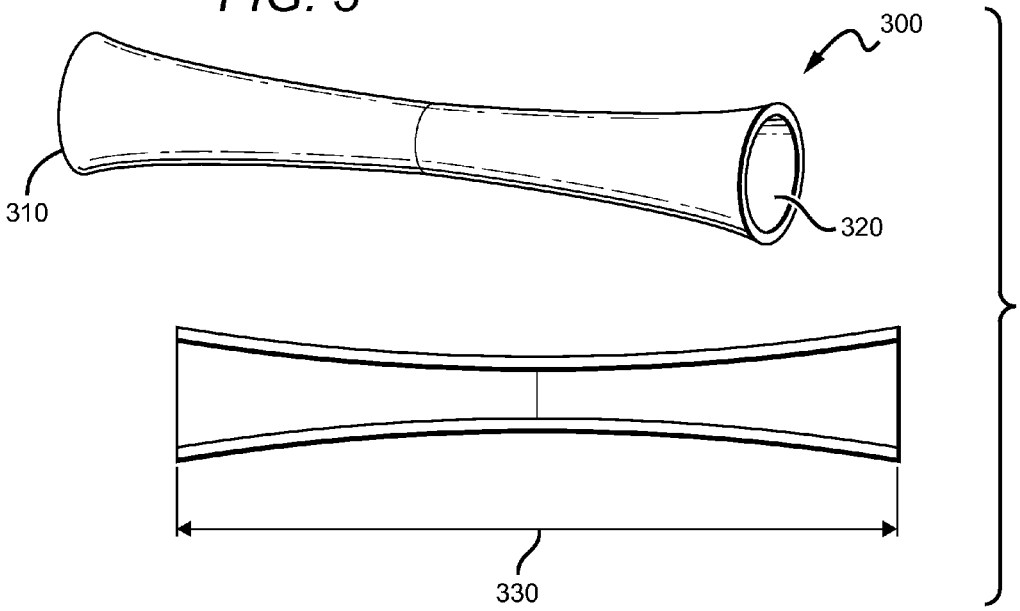
FIG. 3 shows a perspective view and a side view of another duct profile.

FIG. 3 shows a profile view of a duct 300. Duct 300 generally comprises a hollow elongated member having an inlet end 310, and exit end 320, and a length 330. Duct 300 has been designed according to the inventive principles described above. As a result, duct 300 has a geometric shape that maintains the momentum of the air fluid flowing through it such that the momentum remains greater than an adverse pressure gradient present throughout the entire length of duct 300. As a result, no boundary layer separation occurs within duct 300. In addition, duct 300 has a geometric shape that reduces the momentum of the air to approximately zero at as the air exits end 310.

FIG. 5 shows a schematic of a method 500 for designing a duct of an acoustic system. Method 500 starts by providing a first area A1 for a first end of a duct, a second area (A2) for a second end of the duct, and a length of the duct. Next, the duct (i.e., port) resonance with the box is calculated. If this resonance is correct, then the designer can proceed to balance momentum. If the resonance is not correct, then A1, A2, and L are modified and the step of calculating duct resonance is reiterated. Similarly, if the momentum equation is unbalanced, A1, A2, and/or L are adjusted and the previous steps are reiternated until both conditions are satisfied.

FIG. 6 shows a schematic of method 600. Step 610 comprises calculating a momentum of a fluid flowing through the duct as a function of position and duct geometry. Step 620 comprises calculating a pressuring gradient of the fluid as a function of position and duct geometry. Step 630 comprises deriving a duct profile that (i) maintains a momentum of a fluid flowing through the duct to be greater than an adverse pressure gradient present at any location within the duct, such that no boundary layer separation occurs; and (ii) achieves an exit momentum of the fluid of approximately zero.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Groupings of alternative elements or embodiments of the inventive subject matter disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A duct for an acoustic audio transducer enclosure having a profile described by the following equation:

$$A(x) = \frac{A_1}{\left[\left(\frac{g(x)}{g(L)}\right)^a\left(\left(\frac{A_1}{A_2}\right)^{\frac{1}{c}} - 1\right) + 1\right]^c}$$

where $1.0 \le a \le 1.5$ and $0.5 < c \le 1.5$.

2. The duct of claim 1, wherein g(x)=x.

3. A duct for an acoustic audio transducer enclosure having a profile that: (i) maintains a momentum of a fluid flowing through the duct to be greater than an adverse pressure gradient present at any location within the duct, such that no boundary layer separation occurs; and (ii) achieves an exit momentum of the fluid of approximately zero, wherein the fluid has a variable pressure gradient profile.

4. The duct of claim 3, wherein the fluid has a linear velocity profile.

5. A method of designing a duct for an acoustic system, comprising the steps of:

calculating a momentum of a fluid flowing through the duct as a function of position and duct geometry; calculating a pressuring gradient of the fluid as a function of position and duct geometry; and deriving a duct profile that (i) maintains a momentum of a fluid flowing through the duct to be greater than an adverse pressure gradient present at any location within the duct, such that no boundary layer separation occurs; and (ii) achieves an exit momentum of the fluid of approximately zero, wherein the fluid has a variable pressure gradient profile.

6. The method of claim 5, wherein the duct profile also achieves a linear velocity profile.

7. A method of designing a duct of an enclosure for an acoustic system, comprising the steps of:

selecting a first area, a second area, and a duct length, wherein the first and second areas represent areas of first and second ends of the duct, respectively, and wherein the duct length represents a length of the duct; calculating a resonance of the duct and the enclosure to determine whether the resonance meets a specification; if the resonance does not meet the specification, modifying the first area, second area, and length and repeating the step of calculating a resonance of the duct until the specification is met; analyzing a momentum equation to determine whether a fluid flowing through the duct has a momentum that is greater than an adverse pressure gradient; and if the momentum of the fluid is not greater than the adverse pressure gradient, modifying the first area, second area, and length and repeating the steps of (i) calculating a resonance and (ii) analyzing a momentum equation until the resonance the resonance meets a specification and the momentum is greater than the adverse pressure gradient, wherein the fluid has a variable pressure gradient profile.

* * * * *